US012024958B2

(12) United States Patent
Nommensen

(10) Patent No.: US 12,024,958 B2
(45) Date of Patent: Jul. 2, 2024

(54) SUCKER ROD GUIDES

(71) Applicant: Cobalt Extreme Pty Ltd, East Brisbane (AU)

(72) Inventor: David Nommensen, Brisbane (AU)

(73) Assignee: COBALT EXTREME PTY LTD, Queensland (AU)

( * ) Notice: Subject to any disclaimer, the term of this patent is extended or adjusted under 35 U.S.C. 154(b) by 0 days.

(21) Appl. No.: 17/378,141

(22) Filed: Jul. 16, 2021

(65) Prior Publication Data

US 2022/0018195 A1 Jan. 20, 2022

(30) Foreign Application Priority Data

Jul. 16, 2020 (AU) ..... 2020902465

(51) Int. Cl.
*E21B 17/10* (2006.01)

(52) U.S. Cl.
CPC ..... *E21B 17/1071* (2013.01)

(58) Field of Classification Search
CPC ..... E21B 17/10; E21B 17/1071
See application file for complete search history.

(56) References Cited

U.S. PATENT DOCUMENTS 4,757,861 A * 7/1988 Klyne ..... E21B 17/22 175/323
5,339,896 A * 8/1994 Hart ..... E21B 17/1071 166/241.1
5,632,335 A * 5/1997 Campbell ..... E21B 17/1064 166/242.6
9,200,489 B1 * 12/2015 Mabry ..... E21B 17/1071
9,869,135 B1 * 1/2018 Martin ..... E21B 17/042
2009/0183869 A1 * 7/2009 Davison ..... E21B 17/1071 166/241.3
2011/0220348 A1 * 9/2011 Jin ..... E21B 17/1085 166/244.1
2020/0063503 A1 * 2/2020 Reese ..... E21B 17/1064
2020/0340310 A1 * 10/2020 Grensing ..... E21B 17/1071
2021/0348453 A1 * 11/2021 Martin ..... E21B 43/127

OTHER PUBLICATIONS

Yunqing, Gu et al. "Analysis of Drag Reduction Methods and Mechanisms of Turbulent," Applied Bionics and Biomechanics, vol. 2017, Article ID 6858720, 8 pages, https://doi.org/10.1155/2017/6858720.

(Continued)

*Primary Examiner* — David Carroll
(74) *Attorney, Agent, or Firm* — Lewis Roca Rothgerber Christie LLP

(57) ABSTRACT

A sucker rod guide for attachment to a sucker rod or the like has a body comprising a circumferential edge at each end, wherein one or both of the circumferential edges is non-linear. The shape of the non-linear circumferential edge can be symmetrically varying, asymmetrically varying, sinusoidal, castellated or stepped, undulating or randomly or pseudo-randomly profiled, to produce a turbulence stabilization effect. At least a portion of the body of the sucker rod guide, and in particular, a region around one or both of the non-linear circumferential edges comprises a textured surface or a surface structure.

4 Claims, 6 Drawing Sheets

(56) References Cited

OTHER PUBLICATIONS

Wang, J. J. et al. "Drag-reduction characteristics of turbulent boundary layer flow over riblets surfaces," Shipbuilding of China, vol. 42, No. 4, pp. 1-5, 2001.
Yang, H. W. et al. "Experimental study for turbulent drag reduction using a novel boundary control technique," Acta Aeronautica Et Astronautica Sinica, vol. 18, No. 4, pp. 455-457, 1997.
Yubin, Li, et al., "An experimental research of drag reduction using riblets for the Y-7 airplane," Aerodynamic Experiment and Measurement & Control, vol. 9, No. 3, pp. 21-26, 1995.
Cooper, A.J. et al., "The stability of rotating disc boundary-layer flow over a compliant wall. Part 2. Absolute instability," Journal of Fluid Mechanics, vol. 350, pp. 261-270, 1997.
Bixler, Gregory D. et al. "Shark skin inspired low-drag microstructured surfaces in closed channel flow," Journal of Colloid & Interface Science, vol. 393, No. 1, p. 384, 2013.
Woolford, B., et al., (2009), Particle image velocimetry characterization of turbulent channel flow with rib patterned super hydrophobic walls, Physics of Fluids, vol. 21.
Walsh, M.J., et al., (1979), Drag and heat-transfer characteristics of small longitudinal ribbed surfaces, AIAA Journal, vol. 17(7), p. 770-771.

* cited by examiner

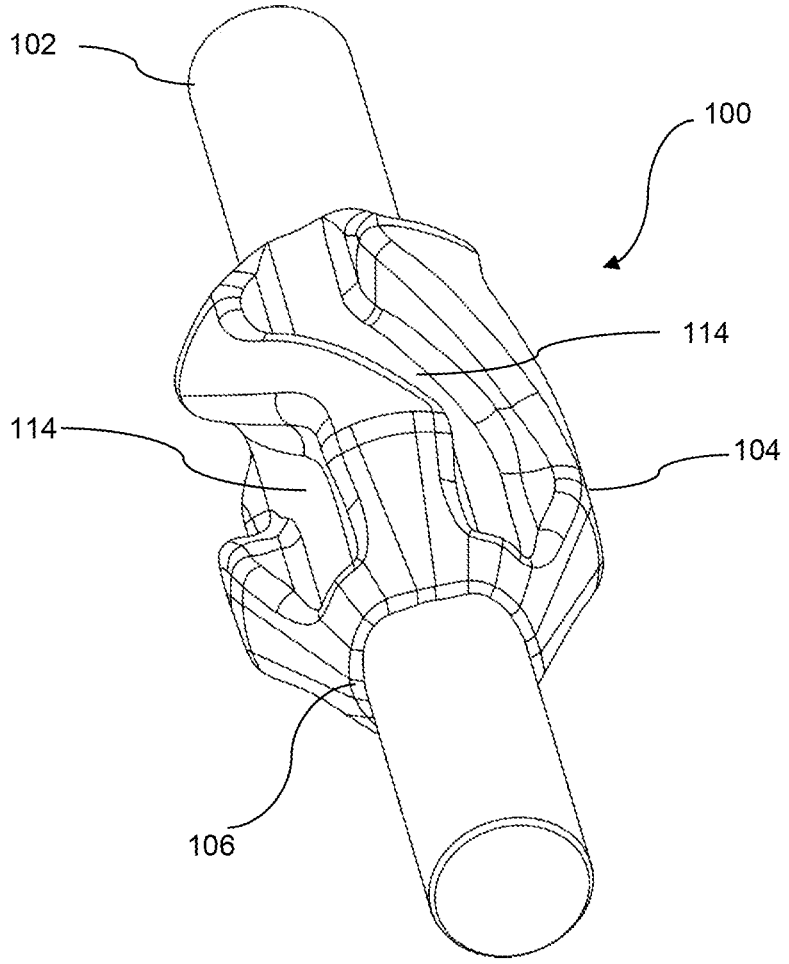
FIG 7
FIG 8A
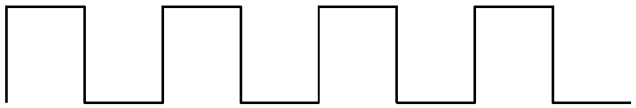
FIG 8B
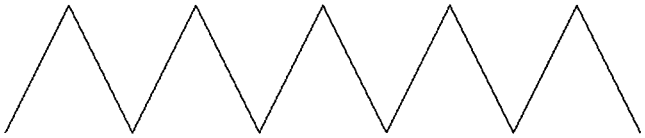

SUCKER ROD GUIDES

CROSS-REFERENCE TO RELATED APPLICATION(S)

This application claims priority to Australian Provisional Patent Application Number 2020902465, filed on Jul. 16, 2020, the entire content of which is incorporated herein by reference.

FIELD OF THE INVENTION

The present invention is directed to sucker rod guides for use with sucker rods, drill pipes, connectors and other downhole tools, particularly downhole oil tools.

BACKGROUND

Sucker rods, tubes, drill pipes, connectors and other downhole tools, particularly downhole oil tools used in oil well pumping typically comprise one or more sucker rod guides or the like to guide the sucker rods, tubes, pipes etc. into and out of the hole.

Sucker rods and the like typically encounter harsh and even extreme conditions during use. Therefore, there is a need to protect the sucker rods from such harsh conditions to maximize the useful life of sucker rods and the like and to reduce the likelihood of failure during use, which can be very costly in terms of downtime and replacement.

One damaging effect on sucker rods is that of turbulence, an example of which is shown in FIGS. 1A and 1B. Turbulence occurs at the edge of the sucker rod guide as the fluid moves up over the guide and back down to the rod, tube or pipe, resulting in corrosion of the sucker rod, particularly at the interface between the sucker rod and the guide, which can lead to failure of the sucker rod. During the pump cycle, the sucker rod guides disrupt the fluid flow, which causes an increase in fluid velocity and a low pressure zone. The increase in fluid velocity causes fluid erosion of the sucker rod and the low pressure zone causes erosion-corrosion and $CO_2$ breakout.

An anti-corrosion film is sometimes applied to the steel sucker rod, tube etc. in an effort to reduce corrosion, but the localized turbulence can prevent the anti-corrosion film from sticking to the steel. Some manufacturers apply a spray metal coating or a factory applied epoxy coating or the like to the exterior of the sucker rod in an effort to prevent corrosion. Such coatings can also be affected by turbulence production fluids which contains sand/fines.

The flow velocities in pumping wells are generally not high enough to influence the corrosion rate, but localized areas of high velocity around the rod guides does occur. High velocity or local turbulence can remove protective scales and inhibitor films (filming amines), particularly when solids are present in the fluid.

Sucker rod guides in reciprocation well pumping operations typically have a contoured shape comprising one or more flutes or channels in an effort to guide the fluids in the hole and reduce the disruption of the fluid flow. Many different designs of sucker rods guides and contoured shapes have emerged over the years in an effort to address the damaging effect of turbulence on sucker rods, including variations in tapering angles of the end portions of the guides, but with little success.

The reference to any prior art in this specification is not, and should not be taken as, an acknowledgement or any form of suggestion that the prior art forms part of the common general knowledge.

OBJECT OF THE INVENTION

A preferred object of the present invention is to provide a sucker rod guide for use with sucker rods, tubes, drill pipes and other downhole tools, particularly downhole oil tools, that addresses, or at least ameliorates one or more of the aforementioned problems and/or provides a useful commercial alternative.

A particularly preferred object of the present invention is to provide a sucker rod guide that reduces the damaging effect of turbulence on sucker rods, tubes, pipes and the like.

SUMMARY OF INVENTION

Generally, the present invention is directed to a sucker rod guide, in particular, for use with sucker rods, tubes, drill pipes and other downhole tools, particularly downhole oil tools.

Generally, embodiments of the sucker rod guide comprise a non-linear edge where the sucker rod guide joins the sucker rod, tube, pipe or the like to reduce the damaging effect of turbulence on the sucker rod, tube, pipe or the like.

Generally, embodiments of the sucker rod guide comprise a textured surface at least in a region around the non-linear edge to reduce or stabilize turbulence and/or drag reduction and/or reduce eddy currents in the fluid.

According to one aspect, but not necessarily the broadest aspect, the present invention resides in a sucker rod guide for attachment to a sucker rod or the like, the sucker rod guide having a body comprising a circumferential edge at each end, wherein at least one circumferential edge is non-linear.

Preferably, both circumferential edges of the sucker rod guide are non-linear. Generally, sucker rod guides are typically identical at each end because it is common practice for wellsite installation that the sucker rod guides are bi-directional for ease and speed of use.

Suitably, the non-linear circumferential edge is at least one of the following shapes: symmetrically varying; asymmetrically varying; sinusoidal; castellated or stepped; undulating; randomly or pseudo-randomly profiled.

Suitably, the body of the sucker rod guide tapers towards at least one of the non-linear circumferential edges, and preferably the body tapers towards both non-linear circumferential edges. Hence, the body comprises a tapered region at, or towards one or both ends.

Preferably, the body of the sucker rod guide comprises one or more flutes or channels along at least part of the length of the body.

Suitably, the one or more flutes or channels are linear or in a spiral or curving or twisting shape along at least part of the length of the body.

Suitably, the sucker rod guide is moulded from any suitable plastics material, in particular, is injection moulded from the Applicant's Arpmax® co-polymer.

In some embodiments, at least a portion of the body of the sucker rod guide comprises a textured surface or surface structure.

Preferably, a region around one or both of the non-linear circumferential edges of the sucker rod guide comprises a textured surface or a surface structure having the effect of turbulence stabilization and/or turbulence reduction and/or drag reduction and/or a reduction in eddy currents.

Preferably, one or both of the tapered regions of the sucker rod guide comprises a textured surface or surface structure.

Preferably, each textured surface or surface structure comprises one or more of the following textures or surface structures: a microstructure; micro-grooves; micro-riblets; micro-ridges; micro-spines; micro-ripples; a nanostructure; nano-grooves; nano-riblets; nano-ridges; nano-spines; nano-ripples; denticles; scales; serrations; corrugations.

According to another aspect, but not necessarily the broadest aspect, the present invention resides in a sucker rod, tube, pipe or tool comprising the aforementioned sucker rod guide.

Further features and/or aspects of the present invention will become apparent from the following detailed description.

BRIEF DESCRIPTION OF THE DRAWINGS

In order that the invention may be readily understood and put into practical effect, reference will now be made to embodiments of the present invention with reference to the accompanying drawings, wherein like reference numbers refer to identical elements. The drawings are provided by way of example only, wherein:

FIG. 7 is an end perspective view of the sucker rod guide shown in FIG. 2;

FIGS. 8A-8C show examples of a non-linear circumferential edge of the sucker rod guide;

Figure 1A:
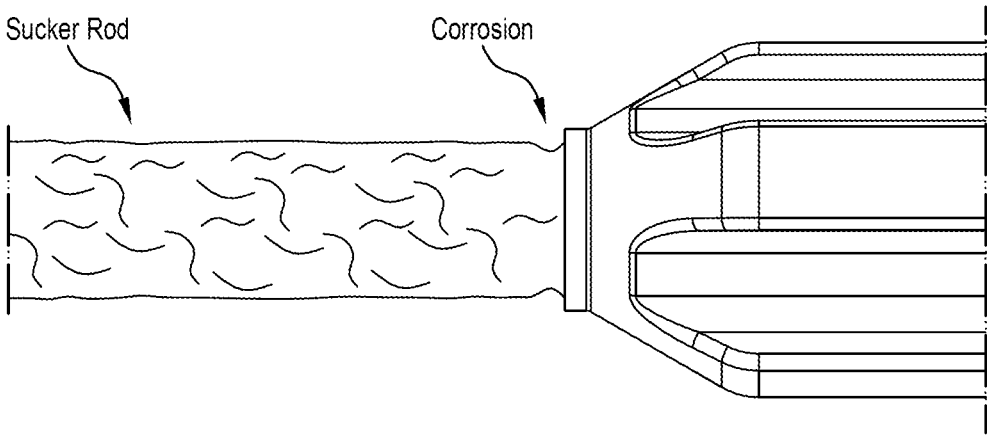
FIG. 1A is a side view of a known sucker rod comprising a sucker rod guide showing corrosion at the edge of the sucker rod guide.
Figure 1B:
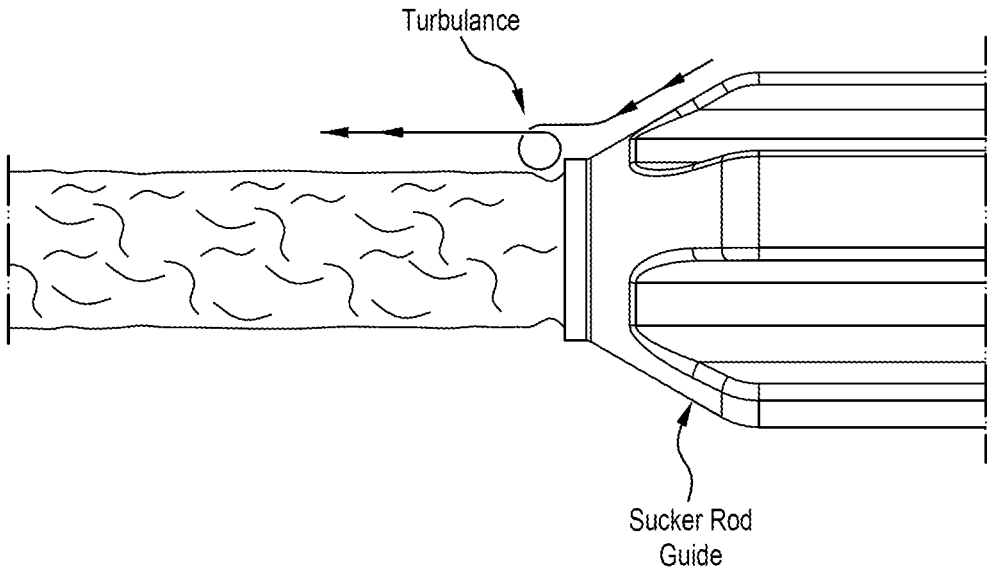
FIG. 1B shows the known sucker rod of FIG. 1A with a fluid flow line indicating turbulence at the edge of the sucker rod guide.
Figure 2:
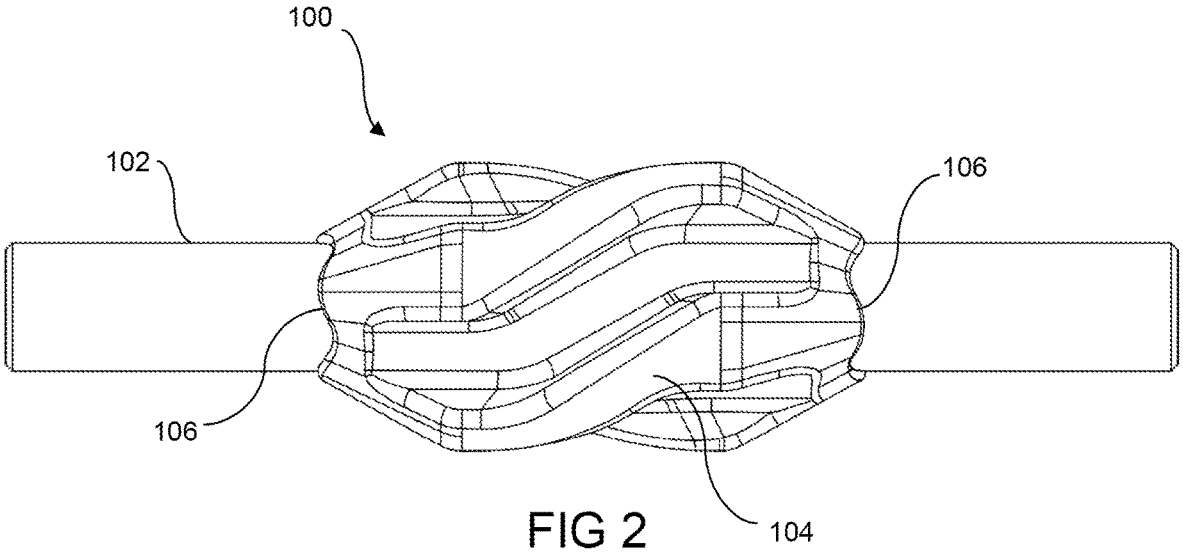
FIG. 2 is a side view of a sucker rod guide, according to an embodiment of the present invention, attached to a sucker rod.
Figure 3:
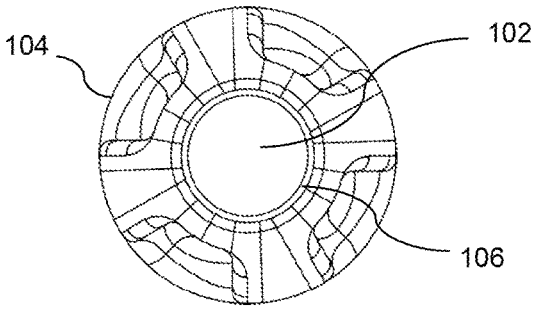
FIG. 3 is an end view of the left side of the sucker rod guide shown in FIG. 2.
Figure 4:
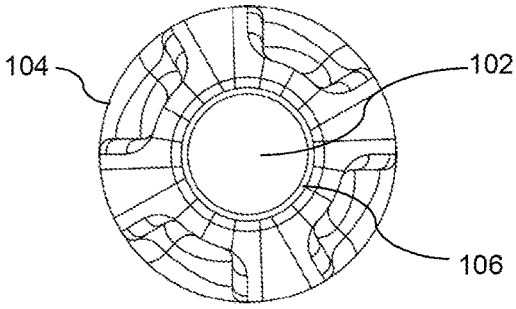
FIG. 4 is an end view of the right side of the sucker rod guide shown in FIG. 2.
Figure 5:
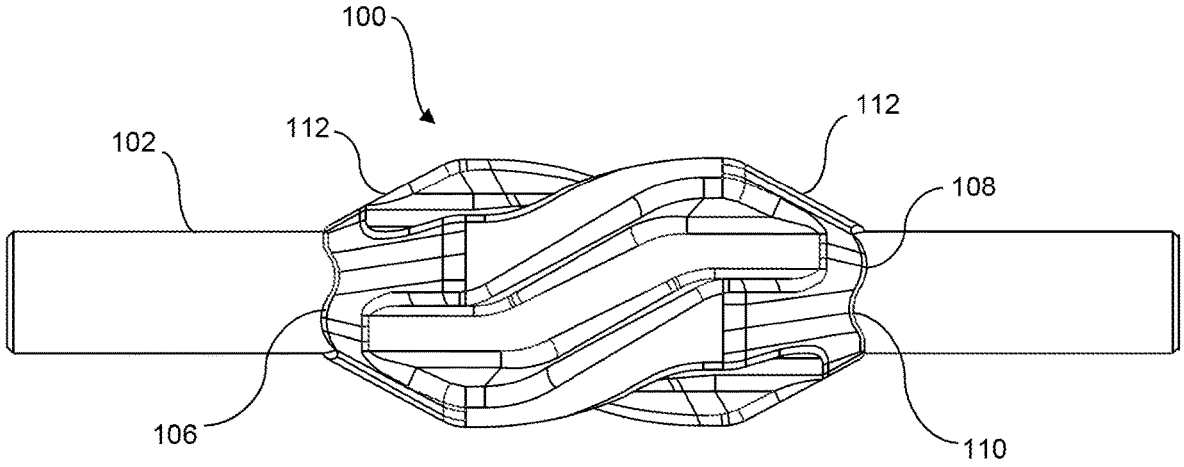
FIG. 5 is a view of the opposite side of the sucker rod guide shown in FIG. 2.
Figure 6:
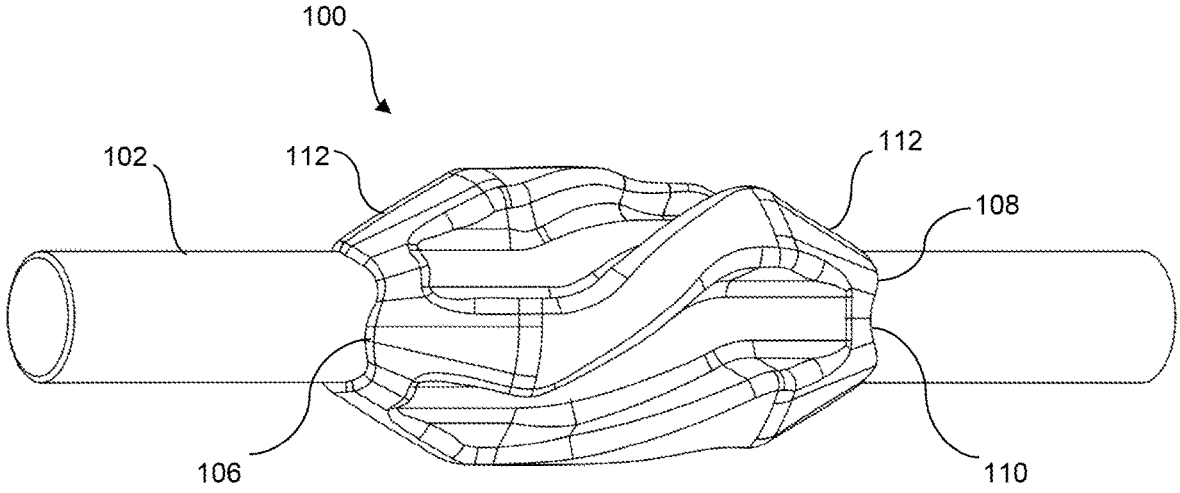
FIG. 6 is a side perspective view of the sucker rod guide shown in FIG. 2.

Skilled addressees will appreciate that elements in the drawings are illustrated for simplicity and clarity and have not necessarily been drawn to scale. For example, the relative dimensions of some elements in the drawings may be distorted to help improve understanding of embodiments of the present invention.

DETAILED DESCRIPTION

According to some embodiments, the present invention is directed to a sucker rod guide, in particular, for use with sucker rods, tubes, drill pipes and other downhole tools, particularly downhole oil tools. Generally, some embodiments of the sucker rod guide comprise a non-linear edge where the sucker rod guide joins the sucker rod, tube, pipe or the like to reduce the damaging effect of turbulence on the sucker rod, tube, pipe or the like. Generally, some embodiments of the sucker rod guide comprise a textured surface at least in a region around the non-linear edge to reduce or stabilize turbulence and/or drag reduction and/or reduce eddy currents in the fluid surrounding the sucker rod guide.

With reference to FIGS. 2-7 a sucker rod guide 100 according to embodiments of the present invention is shown attached to a sucker rod 102 or the like. The sucker rod guide 100 comprises a body 104 comprising a circumferential edge 106 at each end at the interface between the sucker rod guide 100 and the sucker rod 102. According to some embodiments at least one of the circumferential edges 106 is non-linear. In preferred embodiments, both circumferential edges 106 of the sucker rod guide 100 are non-linear.

The inventor has identified that providing a non-linear circumferential edge 106 at one or both edges of the sucker rod guide 100 reduces turbulence in the surrounding fluid at the junction or interface between the sucker rod guide 100 and the sucker rod 100. The non-linear circumferential edge 106 reduces or stabilizes turbulence at the edge of the sucker rod guide 100. The non-linear circumferential edge 106 reduces drag and eddy currents in the fluid surrounding the sucker rod guide 100 at the junction or interface between the sucker rod guide 100 and the sucker rod 100, thus reducing fluid erosion of the sucker rod 102 and thus reducing erosion-corrosion and $CO_2$ breakout.

Figure 8C:
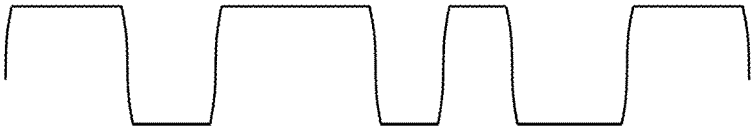

The inventor has identified that the non-linear circumferential edge 106 at one or both edges of the sucker rod guide 100 can have a variety of shapes to reduce or stabilize turbulence, reduce drag and/or eddy currents at the edge of the sucker rod guide 100. For example, the inventor has identified that the non-linear circumferential edge 106 can be at least one of the following shapes: symmetrically varying; asymmetrically varying; sinusoidal; castellated or stepped, as depicted in FIG. 8A; scalloped, undulating; randomly or pseudo-randomly profiled. In other embodiments, the non-linear circumferential edge 106 comprises a plurality of repeating shapes, which can be identical in size and shape, such as the triangular profile shown in FIG. 8B, identical in size, but varying in shape, or identical in shape, but varying in size, such as the profile shown in FIG. 8C. For example, the non-linear circumferential edge 106 can comprise a plurality of equally sized regular or irregular polygons, or a plurality of regular or irregular polygons of two or more different sizes, or a plurality of equally sized regular or irregular polygons of two or more different shapes.

In the example shown in FIGS. 2-7, the non-linear circumferential edge 106 is provided at both edges of the sucker rod guide 100 and comprises a symmetrically varying sinusoidal shape comprising evenly sized and shaped undulations, or symmetrical peaks 108 and troughs 110 of the same amplitude.

In the embodiment shown in FIGS. 2-7, the shape of the non-linear circumferential edge 106 provided at both edges of the sucker rod guide 100 is the same, or substantially the same. Typically, the sucker rod guide 100 is bi-directional, i.e. the same at each end, for ease and speed of installation. Symmetry is not a requirement, but has been the historic standard to enable bi-directional installation. However, in other embodiments, the shape of the non-linear circumferential edge 106 provided at one edge of the sucker rod guide 100 can differ from the shape of the non-linear circumferential edge 106 provided at the other, opposite edge of the sucker rod guide 100. For example, the shape of the non-linear circumferential edge 106 may depend on whether the edge is a leading edge or a trailing edge in the fluid.

In some embodiments, the body 104 of the sucker rod guide 100 tapers towards at least one of the non-linear circumferential edges 106. As shown in FIGS. 2-7, the body 104 tapers towards both non-linear circumferential edges 106. Hence, the body 104 comprises a tapered region 112 at, or towards one or both ends.

In some embodiments, the body 104 of the sucker rod guide 100 comprises one or more flutes or channels 114 along at least part of the length of the body. As shown in FIGS. 2-7, in some embodiments, the body 104 comprises four equally spaced apart flutes or channels 114 in a spiral, curving or twisting pattern extending between the tapered regions 112 at, or towards both ends of the sucker rod guide 100. The flutes or channels 114 assist in directing the fluid over the body 104 of the sucker rod guide 100, reducing wear on the sucker rod 102, and maintaining centralization of the sucker rod 102 inside the tubing.

In preferred embodiments of the present invention, the sucker rod guide 100 is injection moulded onto the sucker rod 102 using the Applicant's Arpmax® co-polymer (a chemically cross-linked polymer material). However, the present invention is not limited thereto. In other embodiments, the sucker rod guide 100 is injection moulded onto the sucker rod 102 using any other suitable plastics material, or formed using an alternative process.

In some embodiments of the present invention, at least a portion of the body 104 of the sucker rod guide 100 comprises a textured surface or a surface structure. In preferred embodiments, a region around one or both of the non-linear circumferential edges 106 of the sucker rod guide 100 comprises a textured surface or a surface structure having the effect of turbulence stabilization and/or turbulence reduction and/or drag reduction and/or a reduction in eddy currents in the fluid surrounding the sucker rod guide 100.

Figure 11:
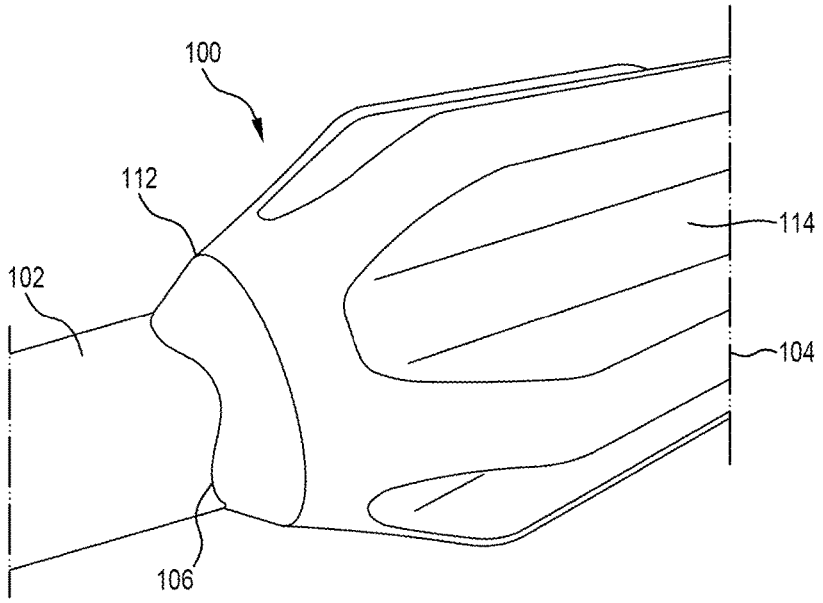
FIG. 11 is a photograph of another embodiment of the sucker rod guide attached to a sucker rod.

FIG. 11 shows a photograph of another embodiment of the sucker rod guide 100 attached to a sucker rod 102. The sucker rod guide 100 comprises a body 104 having a non-linear circumferential edge 106 at both ends, one of which is shown in FIG. 11. In this embodiment, the non-linear circumferential edge 106 has a sinusoidal shape. The body 104 of the sucker rod guide 100 tapers at each end towards the non-linear circumferential edges 106 such that the body 104 comprises tapered regions 112 at each end. In this embodiment, the body 104 comprises eight equally spaced apart flutes or channels 114 in a linear pattern extending between the tapered regions 112 at both ends of the sucker rod guide 100. Three of the flutes or channels 114 are visible in FIG. 11.

Figure 9:
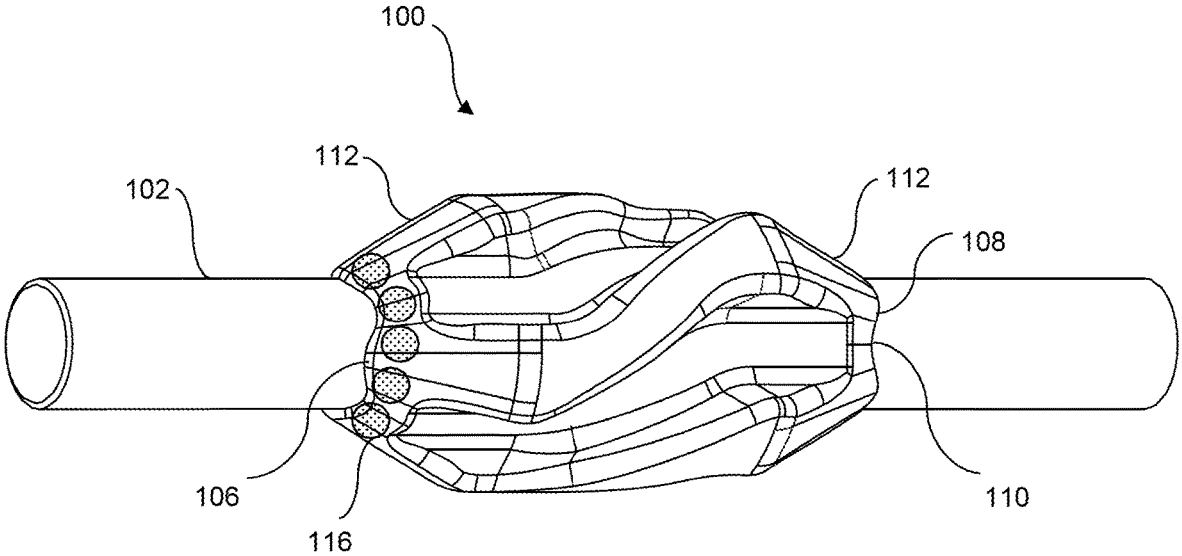
FIG. 9 is a side perspective view of a sucker rod guide comprising one or more regions having a textured surface or a surface structure according to another embodiment of the present invention.

With reference to FIG. 9, in preferred embodiments, one or both of the tapered regions 112 of the sucker rod guide 100 comprises a textured surface or a surface structure. Although the one or more regions 116 having a textured surface or a surface structure are shown in FIG. 9 as a plurality of discrete regions, the one or more regions 116 having a textured surface or a surface structure can be a region extending over part or all of the surface of the sucker rod guide 100. The inventor has identified that providing a textured surface or a surface structure at least in one or more of the regions around one or both of the non-linear circumferential edges 106 stabilizes or reduces turbulence and/or drag and/or eddy currents in the fluid surrounding the sucker rod guide 100.

It is envisaged that the textured surface or surface structure of the body 104 of the sucker rod guide 100 can have a variety of forms. For example, the textured surface or surface structure can comprise one or more of the following textures or surface structures: a microstructure; micro-grooves; micro-riblets; micro-ridges; micro-spines; micro-ripples; a nanostructure; nano-grooves; nano-riblets; nano-ridges; nano-spines; nano-ripples; denticles; scales; serrations; corrugations. The textured surface or surface structure of the body 104 can be achieved by any suitable known technique.

The use of a textured surface or surface structure for downhole well completion and drilling equipment, such as sucker rod guides, centralizers, flow control devices (valves, pumps etc.), drilling tools, stabilizers etc., such as on the body 104 of the sucker rod guide 100 has been inspired, at least in part, by nature, and in particular, by the skin textures of animals, such as sharks. Turbulent flow is a difficult issue in fluid dynamics. Fluid in a turbulent state will result in a greater frictional force, which consumes increased energy. The turbulence stabilization principle of embodiments of the present invention incorporating a textured surface or surface structure, such as a biomechanical surface structure, can be used on its own, or can be combined with the non-linear circumferential edge 106 of the sucker rod guide 100, or other piece of downhole equipment.

When the Reynolds number of fluid in a round pipe reaches $10^5$ and the turbulence intensity is 10%, Reynolds turbulent stress will be about 100 times as much as laminar viscous stress and the greater the stress, the greater the loss of energy, and a lot of energy will be consumed in the flow friction.

Some natural creatures have formed a series of biological surface structures adapting to drag reduction after years of evolution. In recent years, scientists have found that the surface structures of many creatures are non-smooth. For example, the skins of sharks and dolphins have many distributed flakelike rib structures, which can change the skin's surface structure and the turbulent fluid layer and velocity distribution when the shark or dolphin is swimming.

Biomechanics is an emerging discipline which can produce unique characteristics of biological surfaces by imitating biological systems or using technology to design and optimize surfaces for the biological function itself and to process many aspects in function, shape, structure, material, etc. Some descriptions of the surface structures that can be utilized in the present invention include, but are not limited to micro-grooves, micro-riblets, denticles, surface turbulence reduction structures, surface turbulence stabilization structures, scales, micro-spines, serrations, corrugations, micro-ripples, waves and wavelets.

For example, shark skin has a non-smooth surface, which does not adhere to any halobios, and has an excellent drag reduction effect. Its surface is composed of many scales, with a grooved shape, with more spines and setae.

Figure 10:
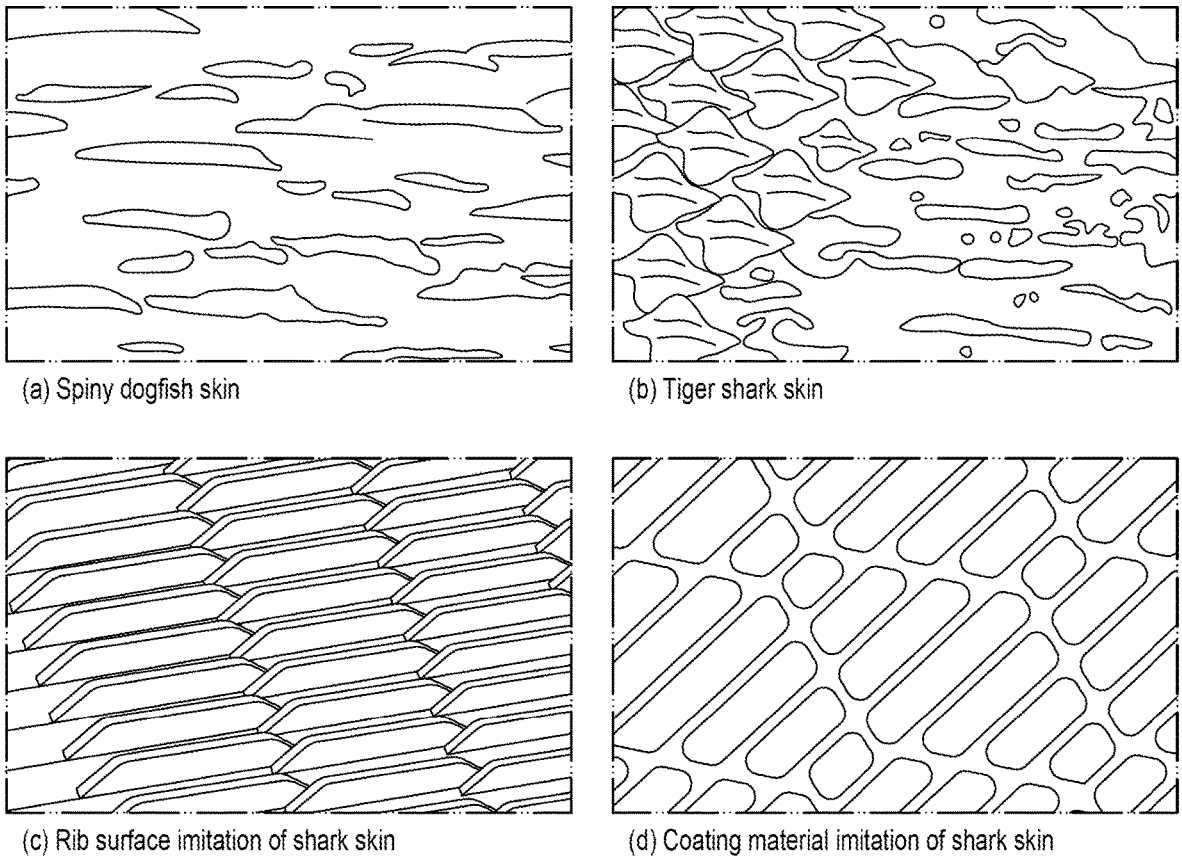
FIG. 10 shows examples of naturally occurring textured surfaces or surface structure and artificially created textured surfaces or surface structures for use in some embodiments of the present invention.

With reference to FIG. 10, the scales of sharkskin, such as the scales of a tiger shark shown in FIG. 10(*b*), are shield scales, which are jagged with a compact, orderly configuration are. The middle scales (serrations) are long, while the side scales are short. The spaces are toward the shark's tail and have an overlapping phenomenon. These can be contrasted with the arrangement of scales of a spiny dogfish shown in FIG. 10(*a*). FIG. 10(*c*) illustrates a rib surface imitation of shark skin and FIG. 10(*d*) illustrates a coating material imitation of a shark skin, which are just two examples of how the surface texture or structure can be achieved. See Reference A.

The cause of drag reduction is that the shark skin structure can change the intrinsic structure and the velocity distribution in the turbulent boundary layer in the fluid when the shark is swimming, which has an effect on drag reduction.

Traditional thought suggests that a smooth surface reduces drag. Research in biomechanics suggests that a micro-grooved surface, for example, can effectively reduce the frictional force on the surface when in a fluid.

By researching groove surface drag reduction, it is considered that there are mainly two aspects that influence its effect. The shape and size of the grooves and the flow-field environment. The flow-field environment includes its pressure gradient, the shape of flow cross-section, and the fluid velocity. Researching a variety of geometries of groove, including V-shape, oval, semicircular, jug-shaped, and rectangular, in some cases the drag reduction effect of a V-shaped groove produces the best results.

Hence, the optimal drag (turbulence) reduction surface is not a smooth surface as described by classic experiments and the turbulent flowing structure of the fluid must be considered. The optimal drag (turbulence) reduction surface should stabilize vortices and secondary eddy currents and transition to laminar flow upstream of the sucker rod guide. See Reference B. This can also change the turbulent characteristics in the near wall region See References C, D & E.

From the theory of turbulent coherent structure, its mechanism is that the stream-wise vortices associated with low-speed zones are reduced and the span-wise gather of the low-speed zones is suppressed under the interaction between stream-wise vortices and secondary eddy currents, which is produced under the edge.

Applied biomechanics enhances fluid flow and strengthens the stability of fluid flow. From the principle of mechanical drag reduction, a similar "air bearing theory" can be put forward.

Another theory that may be utilized in the present invention is that wall vibration interferes with the regenerative cycle of the quasi-stream-wise vortices, not sustaining wall turbulence, which can achieve the effect of drag reduction. See Reference E. Because of the complexity of turbulence, there is no accurate expression about wall drag reduction at present.

It is known that the drag reduction effect of silicone oil is the best because the hydrophobicity of silicone oil can make the wall smoother. Derivatives of silicone oil are incorporated into the Applicant's polymers from which the sucker rod guide 100 and the like are formed.

Bixler and Bhushan obtained a maximum drag reduction rate of 26% by simulating shark skin resistance reduction experiments. See Reference F.

Sharks living in the sea are aquatic animals having rapid movement. The burst start speed of deep-sea sharks is amazing, reaching up to 10-20 m/s, and while pursuing their prey, they maintain a very high speed. There are large gill plates lined in front the body side of sharks, and each lamella has about 5-7 branchial clefts. As they swim, the water is sucked through the half opening mouth, and gas is exchanged from the gill slits. It is closely related with breathing and self-motion resistance reduction. Researchers have found the drag reduction effect on the surface of the jet according to the jet motion of the shark's gills. If there is jet on the motion face, jet fluid will block the mainstream field, forming the counter-current area at the back of the jet hole and the direction of speed near the wall is contrary to flow velocity in the counter-current area having a drag reduction effect. Furthermore, there is the counter-rotating vortex extending downstream produced in the downstream of the jet hole and it would induce two vortices on the wall increasing the thickness of the boundary layer and decreasing the velocity gradient both having the effect of drag reduction.

It is considered that the above-mentioned counter-current flow can be created as a result of swirling fluid flow through the spiral flutes 114 in the body of the sucker rod guide 100.

Traveling wave surface drag reduction technology is another promising drag reduction technology and involves a corrugated shape, which was inspired from the undulating dunes structure of desert. The mechanism of drag reduction for traveling wave surfaces is still under debate. However, it is considered that ripples on the surface of the traveling wave shape can produce secondary flow, namely a row of parallel vortices within the ripples or corrugations, so that it is free to flow in the parallel vortices, achieving the goal of drag and noise reduction. See Reference A.

It is considered that the sucker rod guide 100 of the present invention comprising the non-linear circumferential edge 106 and optionally the flutes 114 optionally combined with the textured surface(s) or structure(s) reduces the fluid eddy currents by producing its own fluid wave, out of phase with the incoming fluid flow path. This results in a destructive interference of the eddy currents generated and the resultant turbulence/cavitation, which results in a turbulence stabilization effect.

One of the main concerns while designing the sucker rod guide 100 is to prevent turbulence related corrosion is to mitigate the eddies and improve the flow along the sucker rod. By improving the flow around the sucker rod, the rod guide turbulence can be reduced.

In a turbulent-flow regime, eddy current reduction can occur when the flow direction is parallel to the micro ridges structure, while span-wise ridges could cause drag to increase. See Reference G.

Riblets are stream-wise microgrooves, which act as a fence against the break-up of span-wise vortices, and consequently reduce the surface shear stress and momentum losses See Reference H. The development of riblets to reduce turbulent skin friction came in part from the study of shark scales. Riblets are believed to lift and pin the naturally occurring fluid vortices in the viscous sublayer.

It will be appreciated that another aspect of the present invention is a sucker rod, tube, pipe, tool or the like comprising the sucker rod guide 100 as described herein.

Hence, embodiments of the present invention address or at least ameliorate at least some of the aforementioned problems of the prior art by reducing and/or stabilizing turbulence and thus reducing corrosion of the sucker rod. The useful life of the sucker rod is therefore prolonged, thus reducing the frequency of replacement, downtime and therefore costs.

In this specification, adjectives such as first and second, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

In this specification, the terms "comprises", "comprising" or similar terms are intended to mean a non-exclusive inclusion, such that an apparatus that comprises a list of elements does not include those elements solely, but may well include other elements not listed.

Throughout the specification the aim has been to describe the invention without limiting the invention to any one embodiment or specific collection of features. Persons skilled in the relevant art may realize variations from the specific embodiments that will nonetheless fall within the scope of the invention.

REFERENCES

Reference A: Analysis of Drag Reduction Methods and Mechanisms of Turbulent, Applied Bionics and Biomechanics, Volume 2017, Article ID 6858720, 8 pages, https://doi.org/10.1155/2017/6858720, Gu Yunqing, Liu Tao, Mu Jiegang, Shi Zhengzan, and Zhou Peijian.

Reference B: J. J. Wang, S. L. Lan, and F. Y. Miao, "Drag-reduction characteristics of turbulent boundary layer flow over riblets surfaces," Shipbuilding of China, vol. 42, no. 4, pp. 1-5, 2001.

Reference C: H. W. Yang and G. Gao, "Experimental study for turbulent drag reduction using a novel boundary control technique," Acta Aeronautica Et Astronautica Sinica, vol. 18, no. 4, pp. 455-457, 1997.

Reference D: Y. B. Li, Z. D. Qiao, and Z. Q. Wang, "An experimental research of drag reduction using riblets for the Y-7 airplane," Aerodynamic Experiment and Measurement & Control, vol. 9, no. 3, pp. 21-26, 1995.

Reference E: A. J. Cooper and P. W. Carpenter, "The stability of rotating disc boundary-layer flow over a compliant wall. Part 2. Absolute instability," Journal of Fluid Mechanics, vol. 350, pp. 261-270, 1997.

Reference F: G. D. Bixler and B. Bhushan, "Shark skin inspired low-drag microstructured surfaces in closed channel flow," Journal of Colloid & Interface Science, vol. 393, no. 1, p. 384, 2013.

Reference G: Woolford, B., Prince, J., Maynes, D. and Webb, B. W., (2009), Particle image velocimetry characterization of turbulent channel flow with rib patterned super hydrophobic walls, Physics of Fluids, Vol. 21.

Reference H: Walsh, M. J. and Weinstein, L. M., (1979), Drag and heat-transfer characteristics of small longitudinal ribbed surfaces, AIAA Journal, Vol. 17(7), p. 770-771.

The invention claimed is:

1. A sucker rod guide for attachment to a sucker rod, tube, pipe, connector or downhole tool used in oil well pumping, the sucker rod guide comprising:

a body having:

a circumferential edge at each end, each circumferential edge being sinusoidal in shape;

a tapered region at, or towards both ends; and one or more flutes or channels extending between the tapered regions in a spiral, curving or twisting pattern;

wherein micro-riblets or denticles defining a surface texture are provided on one or both of the tapered regions.

2. The sucker rod guide of claim 1, wherein the sucker rod guide is moulded from a plastics material.

3. A sucker rod, tube, pipe or tool comprising the sucker rod guide as claimed in claim 1.

4. The sucker rod guide of claim 2, wherein the sucker rod guide is injection moulded from a chemically cross-linked polymer material.

* * * * *